US006634876B2

(12) United States Patent
Osugi et al.

(10) Patent No.: US 6,634,876 B2
(45) Date of Patent: Oct. 21, 2003

(54) VANE PUMP HAVING A VANE GUIDE

(75) Inventors: Akira Osugi, Tochigi (JP); Atsushi Kagawa, Tochigi (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 10/098,536

(22) Filed: Mar. 15, 2002

(65) Prior Publication Data

US 2003/0044300 A1 Mar. 6, 2003

(30) Foreign Application Priority Data

Aug. 30, 2001 (JP) ..... 2001-260923

(51) Int. Cl.[7] ..... F04C 2/344

(52) U.S. Cl. ..... 418/260; 29/888.025; 403/374.1

(58) Field of Search ..... 418/260, 261, 418/264; 29/514, 525, 888.025; 403/279, 282, 367, 368, 374.1

(56) References Cited

U.S. PATENT DOCUMENTS 556,721 A * 3/1896 Briggs ..... 418/260
2,306,233 A * 12/1942 Smith ..... 29/525
4,963,080 A * 10/1990 Hansen ..... 418/260
5,328,337 A 7/1994 Kunta ..... 417/310

FOREIGN PATENT DOCUMENTS

JP SHO 53-56703 5/1978

* cited by examiner

*Primary Examiner*—John J. Vrablik
(74) *Attorney, Agent, or Firm*—Rosenthal & Osha L.L.P.

(57) ABSTRACT

A vane pump is provided with a side plate, a rotor in which a plurality of vanes capable of being in contact with a cam surface of a cam ring is provided so as to freely slide in a diametrical direction, and a vane guide in which the respective vanes at a time of stopping a rotation of the rotor are in contact with an outer peripheral surface so as to set positions in a diametrical direction of the respective vanes. The vane guide constituted by the plate member has a tapered protruding portion integrally formed with the vane guide according to a press working, the protruding portion is pressure inserted to a hole formed in the side plate, and the vane guide is fixed to the side plate.

5 Claims, 4 Drawing Sheets

VANE PUMP HAVING A VANE GUIDE

BACKGROUND OF THE INVENTION

1. Field of the Invention

The present invention relates to a vane pump provided with a rotor in which a plurality of vanes each having an outer end capable of being in contact with a cam surface are provided so as to freely slide in a diametrical direction. More particularly, the present invention relates to a vane pump provided with a vane guide for setting a diametrical position of the vane at a time of stopping a rotation of a rotor.

2. Description of the Related Art

A vane pump provided with a vane guide has been disclosed in Japanese Patent Application Laid-Open (JP-A) No. 53-56703. In this vane pump, in order to easily manufacture, a pin separately formed from an interior cam (corresponding to a vane guide) which is separately formed from a side plate, is fitted to holes formed in the interior cam and the side plate, whereby the interior cam is fixed to the side plate.

In the conventional vane pump mentioned above, since the pin is used for fixing the interior cam to the side plate, it is necessary to work the hole for fitting the pin in the interior cam after forming the interior cam, and fit the pin to the interior cam and the side plate. Additionally, the number of the parts is increased. As a result, the working man-hours and the assembling man-hours are increased, and there is room for improving cost, an assembling property and productivity of the vane pump.

SUMMARY OF THE INVENTION

The present invention relates to a vane pump which may reduce cost by reducing the number of parts, the working man-hours, and the assembling man-hours, and may also improve productivity. The present invention also relates to a vane pump which may improve an assembling property of the vane guide.

In one aspect, the present invention provides a vane pump comprising a pump body. A rotor is arranged rotatably within a pump body having a cam member in which an inner peripheral surface is formed in a cam surface. A plurality of vanes having outer ends capable of being in contact with the cam surface are provided slidably in the rotor so as to freely slide in a diametrical direction. A position in a diametrical direction of each of the vanes at a time of stopping the rotation of the rotor is set by an outer peripheral surface of a vane guide fixed to the pump body with which each of the vanes is in contact. A columnar protruding portion integrally formed in the vane guide constituted by a plate member according to a press working is pressure inserted to a hole formed in the pump body, whereby the vane guide is fixed to the pump body.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

DESCRIPTION OF THE PREFERRED EMBODIMENTS

A description will be given below of an example in accordance with the present invention with reference to FIGS. 1 to 4.

A fixed displacement type vane pump P corresponding to one embodiment of the present invention is driven by a power of a drive source, for example, an internal combustion engine. This vane pump P is used, for example, as an oil pump for supplying a working fluid to fluid pressure application equipment, such as, a hydraulic power steering for a vehicle or a hydraulic continuously variable transmission.

Figure 1:
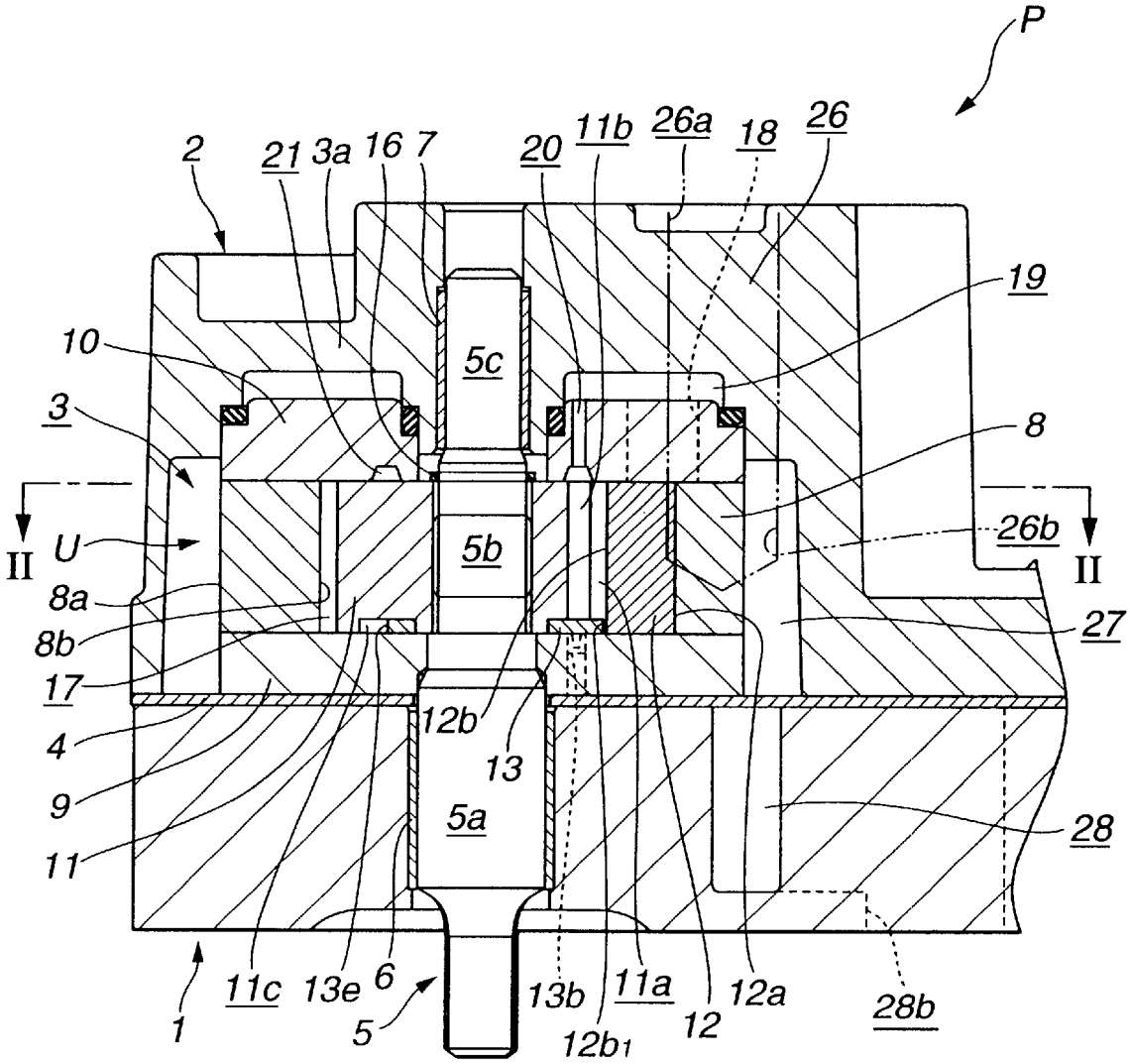
FIG. 1 is a cross sectional view along a line I—I in FIG. 2 of a vane pump according to an example of the present invention.

Referring to FIG. 1, the vane pump P includes a pump unit U, a housing 1, and a cover 2 in which a receiving chamber 3 constituted by a recess portion for receiving the pump unit U is formed. The vane pump P also includes a seal plate 4 gripped between the housing 1 and the cover 2 so as to cover an opening portion of the receiving chamber 3, opening portions of a plurality of grooves formed in the housing 1, and opening portions of a plurality of grooves formed in the cover 2, thereby forming a passage for the working fluid. Further, the seal plate 4 is fastened to the housing 1 together with the cover 2 by a plurality of bolts (not shown) so as to be fixed thereto.

A drive source 5 of the vane pump P, rotated and driven by the power of the internal combustion engine, is rotatably supported in the housing 1 via a slide bearing 6 pressure inserted into an axial hole provided in the housing 1. The drive source 5 is rotatably supported in the cover 2 via a slide bearing 7 pressure inserted to an axial hole provided in a side wall of the cover 2 forming a bottom wall 3*a* of the receiving chamber 3, in a side of a front end portion thereof.

Figure 2:
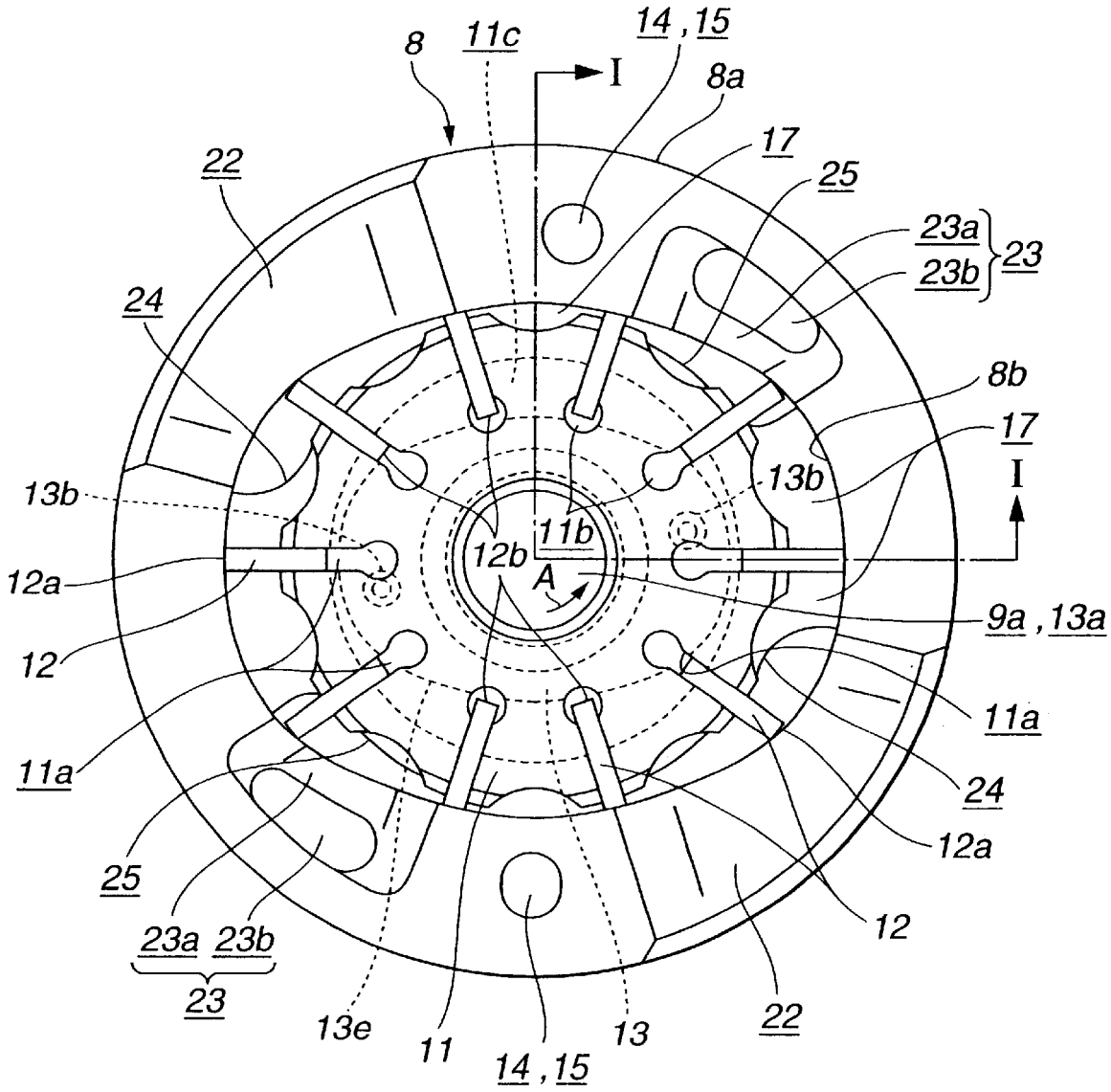
FIG. 2 is a view along a line II—II at a time of taking out a drive shaft in FIG. 1.

Referring to FIG. 1 and FIG. 2 together, the pump unit U is provided with a pump body having an annular cam ring 8 corresponding to a cam member having a circular outer peripheral surface 8*a* and a cam surface 8*b* formed by an inner peripheral surface similar to an oval, a first side plate 9 covering a side surface of the cam ring 8 in a side of the housing 1, and a second side plate 10 covering a side surface of the cam ring 8 in a side of the cover 2. A rotor 11 corresponds to a space formed within the pump body and arranged in an inner side of the cam ring 8. A plurality of vanes 12 respectively are fitted within a plurality of vane grooves 11*a* provided in a peripheral direction of the rotor 11 at a uniform interval so as to be directed to a diametrical direction, in such a manner as to freely slide in a diametrical direction. A vane guide 13 is fixed to the first side plate 9 and received in a circular ring-shaped receiving groove 11*c* formed in a side of the first side plate 9 in the rotor 11.

Figure 3:
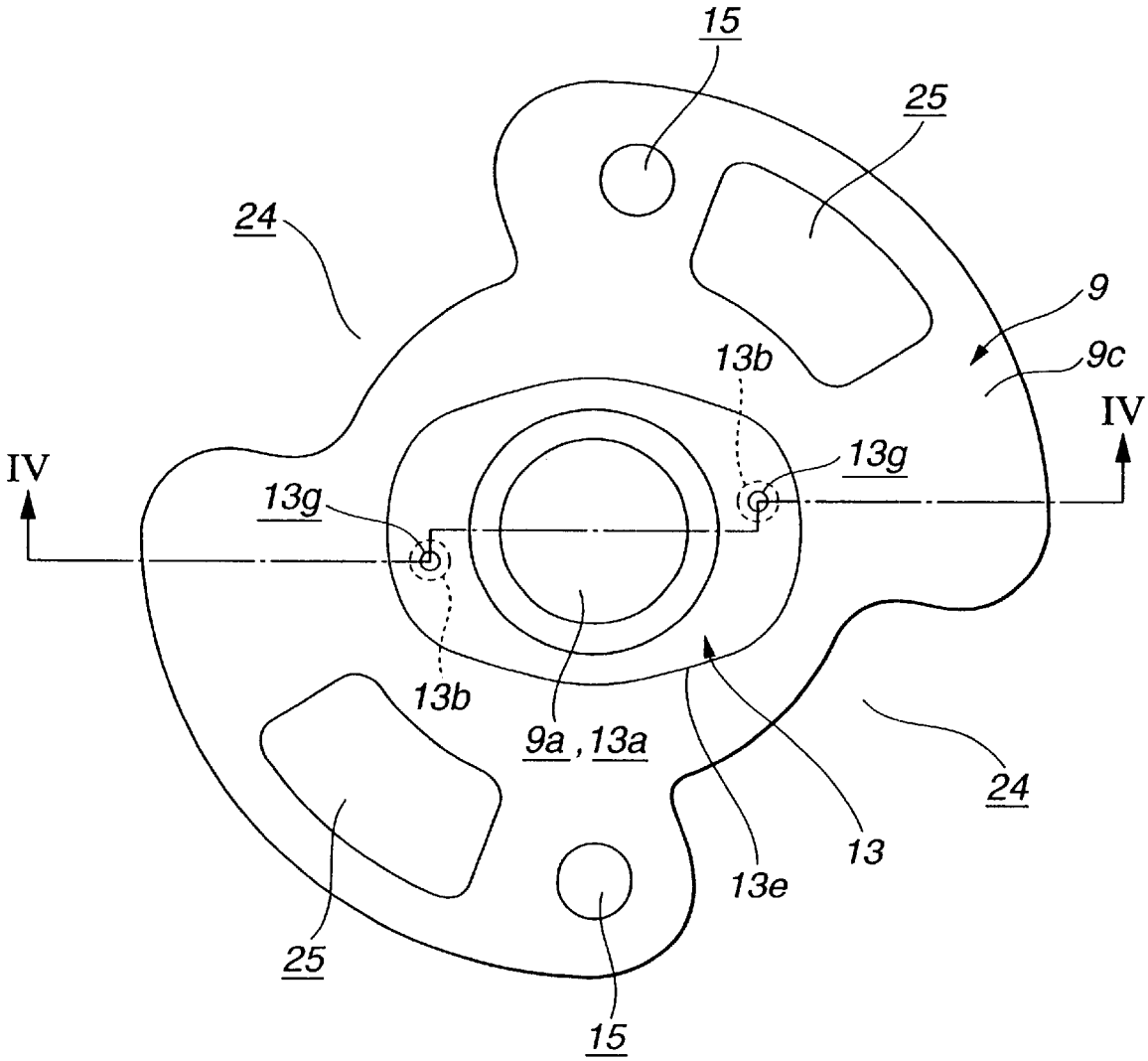
FIG. 3 is a plan view of a side plate to which a vane guide of a vane pump in FIG. 1 is fixed.

In this embodiment, a pair of through holes 14 and 15, respectively, provided in a diametrical direction are respectively provided in the cam ring 8 and the first side plate 9 (refer to FIG. 3). Respective one end portions of a pair of positioning pins (not shown) extending through the through holes 14 and 15 are pressure inserted in a pair of holes constituted by blind holes provided in the second side plate 10, whereby the pump unit U is integrated. Then, respective another end portions of a pair of positioning pins in a state of protruding from the first side plate 9 extends through the hole of the seal plate 4 so as to be respectively pressure inserted in a pair of holes constituted by the blind holes provided in the housing 1, whereby the pump unit U is assembled in the housing 1. Thereafter the drive shaft 5 is inserted from the side of the slide bearing 6, a journal portion 5*a* is supported in the slide bearing 6, and a connection portion 5*b* is spline connected to the rotor 11, whereby the drive shaft 5 and the rotor 11 integrally rotate. Thereafter a retaining ring 16 is attached thereto, and next, the cover 2 is assembled with the housing 1 so that the slide bearing 7 is fitted to the journal portion 5*c* in the side of the front end portion.

Outer ends 12*a* in a diametrical direction of the respective vanes 12 are formed so as to be capable of being in contact with the cam surface 8*b* of the cam ring 8. A space between the cam surface 8*b* and the outer peripheral surface of the rotor 11 and between the first and second side plates 9 and 10 is defined by a plurality of vanes 12, whereby a plurality of pump chambers 17 are formed.

Further, vane back pressure chambers 11*b,* which communicate with bottom portions of the respective vane grooves 11*a,* are formed in the rotor 11. A high pressure chamber 19, to which a part of the working fluid discharged from the pump chamber 17 is introduced via a communication passage 18 formed in the second side plate 10, is formed between the bottom wall 3*a* of the receiving chamber 3 and the second side plate 10. A circular ring-like supply groove 21 which communicates with each of the vane back pressure chambers 11*b* and a plurality of supply passages 20 which allows communication between the high pressure chamber 19 and the supply groove 21 are formed on a side surface of the second side plate 10 on a side of the rotor 11. Further, at a time of an operation in which the vane pump P discharges the working fluid having a discharge pressure equal to or more than a predetermined value, the working fluid in the high pressure chamber 19 is supplied to each of the vane back pressure chambers 11*b* via the supply passage 20 and the supply groove 21, whereby each of the vanes 12 is exposed to a force being pressed outward in the diametrical direction within the vane groove 11*a,* so that the outer end 12*a* of each of the vanes 12 is pressed against the cam surface 8B (refer to FIG. 2), and a seal between the outer end 12*a* of each of the vanes 12 and the cam surface 8*b* is executed.

Referring to FIG. 2, four suction ports 22 constituted by a pair of grooves provided so as to be open to the outer peripheral surface 8*a* and the cam surface 8*b,* and two discharge ports 23 constituted by a pair of grooves 23*a* respectively provided so as to be open only to the cam surface 8*b* and a through hole 23*b* communicating with both grooves 23*a* are respectively provided in respective side surfaces of the cam ring 8 and both side surfaces thereof at opposing positions in the diametrical direction. The suction port 22 and the discharge port 23 communicate with the pump chamber 17.

Referring to FIG. 2 and FIG. 3 together, a pair of suction ports 24 constituted by notch portions in the diametrical direction and in communication with the pump chamber 17 are formed in the first side plate 9 in which the insertion hole 9*a* for inserting the drive shaft 5 therethrough is formed at positions aligning with the suction ports 22 in the side of the first side plate 9 of the cam ring 8. A pair of discharge ports 25 constituted by the through hole and in communication with the pump chamber 17 are formed at positions aligning with the discharge ports 23.

Further, referring to FIG. 1, an inlet passage 26 extending in an axial direction is provided in the cover 2. An inlet 26*a* of the inlet passage 26 communicates with a reservoir in which the working fluid is stored, via an oil pipe. An outlet 26*b* of the inlet passage 26 communicates with an annular passage 27 formed between a peripheral wall surface of the receiving chamber 3 and an outer peripheral surface of the pump unit U. Accordingly, the annular passage 27 communicates with the suction port 22 of the cam ring 8 and the suction port 24 of the first side plate 9.

A discharge passage 28 constituted by a groove covered by the seal plate 4 is provided in the housing 1. An inlet of the discharge passage 28 communicates with the discharge port 23 of the cam ring 8 and the discharge port 25 of the first side plate 9 via the opening provided in the seal plate 4. An outlet 28*b* of the discharge passage 28 communicates with a working fluid passage in the fluid pressure application equipment.

Figure 4:
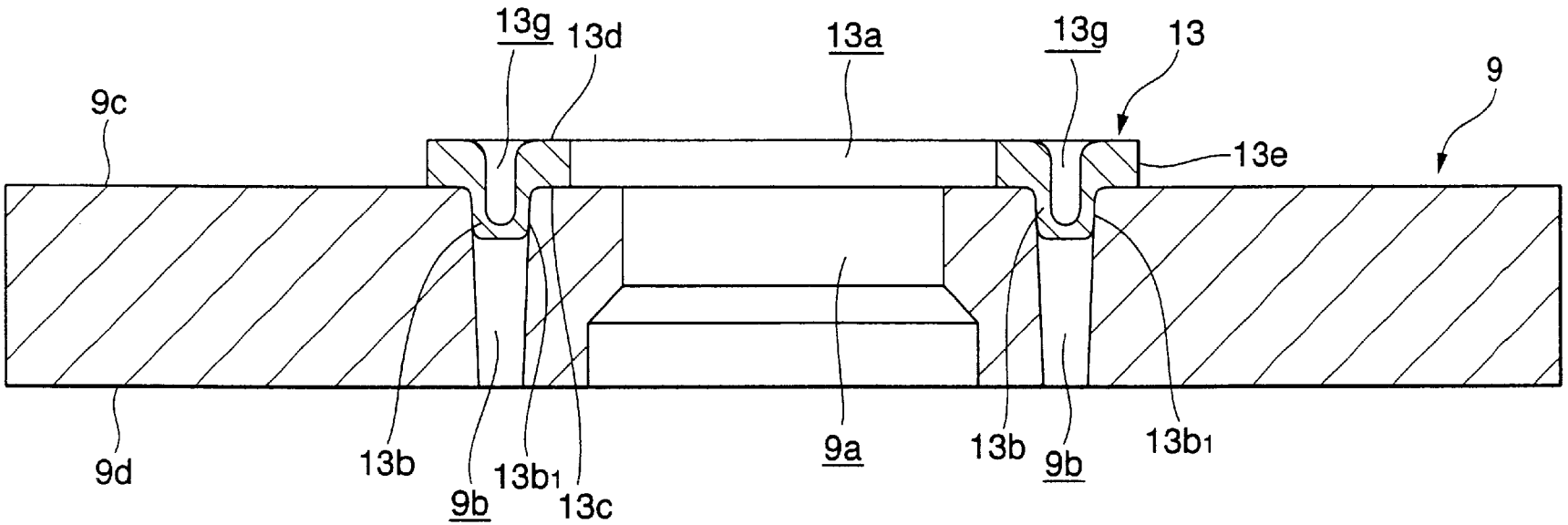
FIG. 4 is a cross sectional view along a line IV—IV in FIG. 3.

Referring to FIGS. 3 and 4, the vane guide 13 is constituted by a flat-shaped metal plate member. The vane guide 13 has a circular center hole 13*a* to which the drive shaft 5 is inserted, and a pair of protruding portions 13*b* provided in one side surface 13*c* brought into contact with the side surface of the first side plate 9 and formed in a columnar tapered shape having an outer peripheral surface 13*b*1 constituted by a conical surface. Additionally a pair of mounting holes 9*b* constituted by a through hole having a circular transverse section formed in a tapered shape toward an outer surface 9*d* from an inner surface 9*c* are formed in the first side plate 9. Each of the mounting holes 9*b* has an inner wall surface constituted by a conical surface having an apex angle substantially equal to that of a conical surface forming the outer peripheral surface 13*b*1 of the protruding portion 13*b,* and has an inner diameter to which the protruding portion 13*b* is pressure inserted. Further, both of the protruding portions 13*b* are respectively pressure inserted into both of the mounting holes 9*b,* whereby the vane guide 13 is fixed to the first side plate 9 in the inner surface 9*c*.

Further, referring to FIGS. 1 and 2 together, a shape of an outer peripheral surface 13*e* of the vane guide 13 is substantially similar to the cam surface 8*b*. The shape forms a diametrical gap being substantially fixed in a peripheral direction, with respect to the cam surface 8*b,* in a state in which the pump unit U is assembled in the housing 1 and the cover 2 together with the drive shaft 5. A side end portion 12*b*1 (refer to FIG. 1) in a side of the first side plate 9 of the inner end 12*b* in the diametrical direction of each of the vanes 12 is in contact with the outer peripheral surface 13*e* of the vane guide 13, at a time when the rotation of the rotor 11 stops in a state in which the vane pump P is in a non-operating state. Accordingly, the positions in the diametrical direction of the respective vanes 12 are set so that the outer ends 12*a* of the respective vanes 12 have a place in positions opposing to each other via a slight gap with respect to the cam surface 8*b,* or positions being slightly in contact with the cam surface 8*b,* at a time of stopping the rotation of the rotor 11.

In this embodiment, the vane guide 13 is formed by press working a plate member having a uniform thickness. That is, the center hole 13*a* may be formed according to a punching work, or the outer peripheral surface 13*e* is formed according to a blanking work. Further, with respect to both of the protruding portions 13*b,* the protruding portion may be formed by pressing a punch having an outer diameter smaller than a diameter of a forming hole corresponding to a finish outer shape thereof to a die having the forming hole, thereby protruding the side surface 13*c* corresponding to the side surface in a side of the die of the vane guide 13 while forming a recess portion 13*g* in the side surface 13*d* in a side of the rotor 11 corresponding to a side surface in a side of the punch of the vane guide 13, whereby the protruding portion 13*b* having an outer shape corresponding to the forming hole is formed.

When the vane pump P structured in the manner mentioned above is operated, and the rotor 11 starts rotating in a rotational direction A (refer to FIG. 2) integrally with the drive shaft 5, the outer end 12*a* of each of the vanes 12 forms a slight gap with respect to the cam surface 8*b* or is slightly in contact therewith due to the vane guide 13. Therefore, the working fluid passing through the inlet passage 26 and the annular passage 27 is effectively sucked and discharged immediately after the vane pump P starts. That is, with respect to the pump chamber 17 in which a capacity thereof is going to be increased in correspondence to the rotation of the rotor 11, the working fluid sucked from the reservoir via the inlet passage 26 is sucked from the suction port 22 and the suction port 24 which communicate with the pump chamber 17 through the annular passage 27. Further, after the capacity of the pump chamber 17 reaches a maximum level, the working fluid within the pump chamber 17 is discharged from the pump chamber 17 in which the capacity thereof is going to be reduced to the discharge port 23 and the discharge port 25 which are in communication. The working fluid further reaches the outlet 28*b* through the discharge passage 28, and is supplied to the working fluid passage of the fluid pressure application equipment from the outlet 28*b*. Accordingly, it is possible to supply the working fluid having normal discharge amount and discharge pressure to the fluid pressure application equipment at an early stage immediately after starting the vane pump P.

Hereinafter, a description will be given of an operation and an effect of the example structured in the manner mentioned above.

In the vane pump P, since the respective columnar protruding portions 13*b* pressure inserted to the respective mounting holes 9*b* formed in the first side plate 9 are integrally formed by the press working with respect to the vane guide 13 constituted by the plate member, a number of the parts, working man-hours and assembling man-hours maybe reduced. Further, it is possible to reduce a cost of the vane pump P and it is possible to improve a productivity. Further, since the respective protruding portions 13*b* pressure inserted to the first side plate 9 are integrally formed with the vane guide 13, the vane guide 13 and the respective protruding portions 13*b* have no play. Therefore it is possible to prevent the positions of the respective vanes 12 from fluctuating in the diametrical direction at a time of stopping the rotation of the rotor 11. It is also possible to secure a stable discharge amount immediately after the start of the vane pump P, because there is not generated an increase of weight caused by providing both protruding portions 13*b* for fixing the vane guide 13, in comparison with the prior art using the pin. It is also possible to reduce the weight of the vane pump P.

Further, since the respective protruding portions 13*b* are formed in the tapered shape, it becomes easy to position the respective protruding portions 13*b* with respect to the mounting hole 9*b* of the first side plate 9 at a time of assembling the vane guide 13, so that an assembling property of the vane guide 13 in the first side plate 9 is improved.

A description will be given of an example obtained by modifying the structure of a part of the example mentioned above, with respect to modified structures.

In the example mentioned above, the vane guide 13 is provided only in the first side plate 9. However, in other embodiments, the vane guide 13 may be provided only in the second side plate 10, or it may be provided in both side plates 9 and 10. Further, in the example mentioned above, the pump body has a pair of side plates 9 and 10. However, in other embodiments, the pump body may be structured such that one side of the cam ring 8 is covered by a side plate and another side of the cam ring 8 is covered by the housing 1 or the cover 2.

In the example mentioned above, the protruding portion 13*b* is formed so that a whole thereof is tapered. However in other embodiments, the protruding portion 13*b* may be formed so that only the front-end portion is tapered. Further in the example mentioned above, the protruding portion 13*b* and the mounting hole 9*b* are formed in the tapered shape having a circular transverse section. However, in other embodiments, the protruding portion 13*b* and the mounting hole 9*b* may be formed in a tapered shape having a non-circular transverse section. Further in other embodiments, the protruding portion 13*b* and the mounting hole 9*b* may be respectively constituted by a columnar protruding portion and a through hole in which transverse sections are formed in the same circular shape or the same non-circular shape in an axial direction. Further, the mounting hole 9*b* may be constituted by a closed-end hole in place of the through hole.

As heretofore explained, embodiments of the present invention have been described in detail with reference to the drawings. However, the specific configurations of the present invention are not limited to the embodiments shown or described. Rather, those having a modification of the design within the range of the present invention are also included in the present invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiments set out above, but should be understood to include all possible embodiments which can be embodied within a scope encompassed and equivalents thereof with respect to the features set out in the appended claims.

What is claimed is:

1. A vane pump comprising:

a pump body, the pump body comprising a cam member having a cam surface defined therein;

a rotor rotatably mounted in the pump body;

a plurality of vanes mounted on the rotor and adapted to freely slide in a diametrical direction with respect to the rotor, the vanes having outer ends adapted to contact with the cam surface; and a vane guide fixed in the pump body in contact with each of the vanes, said vane guide having an outer peripheral surface that sets a position in a diametrical direction of each of the vanes at a time of stopping of rotation of the rotor;

wherein a columnar protruding portion integrally formed in the vane guide is pressure inserted in a hole formed in the pump body to fix the vane guide to the pump body.

2. A vane pump comprising:

a rotor rotatably arranged within a pump body having a cam member in which an inner peripheral surface is formed in a cam surface;

a plurality of vanes having outer ends capable of being in contact with the cam surface, the vanes being slidably provided in the rotor so as to freely slide in a diametrical direction; and a position in a diametrical direction of each of the vanes at a time of stopping the rotation of the rotor being set by an outer peripheral surface of a vane guide fixed to the pump body with which each of the vanes is in contact, wherein a columnar protruding portion integrally formed in the vane guide constituted by a plate member according to a press working is pressure inserted to a hole formed in the pump body, whereby the vane guide is fixed to the pump body.

3. A vane pump as claimed in claim 2, wherein the columnar protruding portion is formed in a tapered shape.

4. A vane pump as claimed in claim 2, wherein the pump body has a side plate covering a side portion of the cam member, and the columnar protruding portion of the vane guide is press inserted in holes formed on the side plate.

5. A vane pump as claimed in claim 2, wherein at least a front-end portion of the columnar protruding portion is formed tapered.

* * * * *